US005441851A

United States Patent [19]

Singer et al.

[11] Patent Number: 5,441,851

[45] Date of Patent: Aug. 15, 1995

[54] USE OF HETEROCYCLIC NITROGEN ADDENDA TO REDUCE CONTINUED COUPLING OF MAGENTA DYE-FORMING COUPLERS

[75] Inventors: Stephen P. Singer, Spencerport; Paul B. Merkel, Rochester, both of N.Y.

[73] Assignee: Eastman Kodak Company, Rochester, N.Y.

[21] Appl. No.: 797,660

[22] Filed: Nov. 25, 1991

[51] Int. Cl.[6] ..... G03C 7/384; G03C 7/392

[52] U.S. Cl. ..... 430/372; 430/382; 430/387; 430/544; 430/551; 430/555

[58] Field of Search ..... 430/372, 382, 387, 544, 430/551, 555, 613, 614, 611, 607, 449

[56] References Cited

U.S. PATENT DOCUMENTS

| | | | |
|---|---|---|---|
| 4,298,683 | 11/1981 | Becker et al. | 430/614 |
| 4,416,977 | 11/1983 | Ohashi et al. | 430/613 |
| 4,483,918 | 11/1984 | Sakai et al. | 430/372 |
| 4,503,139 | 3/1985 | Bartels-Keith et al. | 430/614 |
| 4,555,479 | 11/1985 | Sakai et al. | 430/372 |
| 4,585,728 | 4/1986 | Furutachi et al. | 430/372 |
| 4,990,438 | 2/1991 | Ogi et al. | 430/613 |
| 5,049,483 | 9/1991 | Yatsuyanagi et al. | 430/611 |
| 5,120,637 | 6/1992 | Furusawa et al. | 430/512 |

FOREIGN PATENT DOCUMENTS

| | | | |
|---|---|---|---|
| 545966 | 9/1957 | Canada | 430/613 |
| 0256820 | 2/1988 | European Pat. Off. | 430/614 |
| 1132944 | 6/1986 | Japan | 430/611 |
| 3046442 | 2/1988 | Japan | 430/614 |
| 1013148 | 1/1989 | Japan | 430/555 |
| 1295257 | 11/1989 | Japan . | |
| 858326 | 1/1961 | United Kingdom | 430/611 |
| 0081768 | 9/1986 | United Kingdom . | |

*Primary Examiner*—Lee C. Wright
*Attorney, Agent, or Firm*—Gordon M. Stewart

[57] ABSTRACT

A photographic element with a support and a silver halide emulsion layer includes a two-equivalent pyrazolone magenta dye-forming coupler and a heterocyclic nitrogen addendum which is a protic imidazole or a pyridine. The heterocylic nitrogen compound reduces continued coupling of two-equivalent magenta dye-forming couplers after removal from a developer solution, obviating the need for a stop bath after the development stage.

26 Claims, No Drawings

USE OF HETEROCYCLIC NITROGEN ADDENDA TO REDUCE CONTINUED COUPLING OF MAGENTA DYE-FORMING COUPLERS

BACKGROUND OF THE INVENTION

The invention pertains to novel compositions and methods for processing photographic elements. More specifically, the invention relates to novel compositions containing a heterocyclic nitrogen addendum and a magenta dye-forming coupler and to a method for developing an image in the presence of the novel composition. The term addenda refers to components added to the oil phase other than coupler or coupler solvent.

Films containing two-equivalent pyrazolone magenta dye-forming couplers with coupling off groups show a propensity for continued coupling when taken out of a developer solution and placed directly, without an intervening stop bath, in a bleach solution. This can cause undesirable increases in background density, that is, stain. Use of more active bleaches, and increases in bleach pH on seasoning, tend to aggravate this phenomenon.

The use of aromatic amines to reduce magenta dye stain with two-equivalent pyrazolone magenta dye-forming couplers has been proposed, for example, in U.S. Pat. No. 4,483,918 and European Patent Application 81,768. The references indicate that stain arising from continued coupling is among the types of stain to be reduced with aromatic amine addenda.

The use of certain heterocyclic and aliphatic amines in combination with two-equivalent pyrazolone couplers to reduce stain is described in U.S. Pat. No. 4,555,479 and U.S. Pat. No. 4,585,728. However, the amine addenda of the prior art often do not reduce continued coupling to a sufficient extent. Furthermore, the prior art addenda often suffer from instability problems.

There has thus been a need to reduce the continued coupling of two-equivalent pyrazolone magenta dye-forming couplers to a sufficient extent without greatly reducing the coupler activity.

SUMMARY OF THE INVENTION

This and other needs have been satisfied by providing heterocyclic nitrogen compounds selected from the group consisting of protic imidazoles and pyridines as dispersion addenda to reduce continued coupling of two-equivalent pyrazolone magenta dye-forming couplers.

There has further been provided a photographic element comprising a support and a silver halide emulsion layer having associated therewith a two-equivalent pyrazolone magenta dye-forming coupler, wherein the element further comprises a heterocyclic nitrogen compound selected from the group consisting of protic imidazoles and pyridines. The term "associated therewith" means that the concerned materials are coated in the same dispersion or the same layer such that they interact during processing.

Additionally there has been provided a method for developing an image in a photographic element comprising a support and a silver halide emulsion containing an imagewise distribution of developable silver halide grains, comprising the step of developing the element with a silver halide color developing agent in the presence of a two-equivalent magenta dye-forming coupler and a heterocyclic nitrogen addendum selected from the group consisting of a protic imidazole and a pyridine. The instant addendum allows for the process to be performed without a stop bath after the development stage because the addendum serves to reduce continued coupling.

There is also provided a multicolor photographic element comprising a support bearing a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler and a yellow dye image-forming unit comprising at least one blue-sensitive silver halide emulsion layer having associated therewith at least one yellow dye-forming coupler, wherein the magenta dye-forming coupler is a two-equivalent pyrazolone magenta coupler, and wherein the magenta dye-forming coupler is associated with a heterocyclic nitrogen addendum selected from the group consisting of protic imidazoles and pyridines.

DETAILED DESCRIPTION OF THE PREFERRED EMBODIMENTS

It has now been discovered that the use of protic imidazoles and pyridines as dispersion addenda reduce the continued coupling of two-equivalent pyrazolone magenta dye-forming couplers without greatly reducing coupler activity. The protic imidazoles are more effective than the amine or aniline derivatives of the prior art in reducing continued coupling without reducing continued stability. The pyridine derivatives offer stability advantages due to their high oxidation potentials. The amine addenda are used in amounts so as to reduce the continued coupling of the couplers. Preferably a weight ratio of addenda to coupler of about 0.02 to about 2.0, most preferably about 0.05 to about 1.0, is used.

By "protic imidazole" is denoted an imidazole with an NH group. The preferred protic imidazoles are represented by formula I

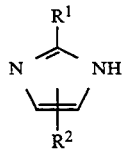

I in which $R^1$ and $R^2$ are individually hydrogen, unsubstituted or substituted straight-chain or branched alkyl, preferably having 1 to 30 carbon atoms, unsubstituted or substituted alkenyl, preferably having 2 to 30 carbon atoms, unsubstituted or substituted alkoxy, preferably having 1 to 30 carbon atoms, unsubstituted or substituted aryl, preferably having 6 to 30 carbon atoms or groups of the formulae II

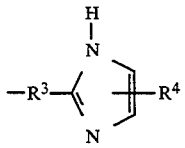

II or III

-continued

III

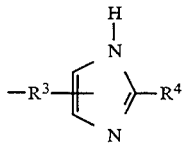

wherein $R^3$ is unsubstituted or substituted alkylene, preferably having 1 to 40 carbon atoms, and $R^4$ is hydrogen, unsubstituted or substituted straight-chain or branched alkyl, preferably having 1 to 30 carbon atoms, or unsubstituted or substituted alkenyl, preferably having 2 to 30 carbon atoms, with the proviso that no more than one of $R^1$ and $R^2$ is a group of the formulae II or III. When one of $R^1$ and $R^2$ is one of these two groups, the resultant imidazole compound is a bis compound.

The preferred pyridines are represented by general formula IV

IV

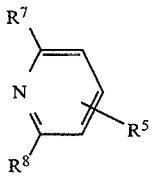

in which $R^5$ is hydrogen, unsubstituted or substituted straight-chain or branched alkyl, preferably having 1 to 30 carbon atoms, unsubstituted or substituted alkenyl, preferably having 2 to 30 carbon atoms, or a group of the formula V

V

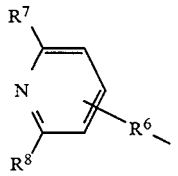

wherein $R^6$ is unsubstituted or substituted alkylene, preferably having 1 to 40 carbon atoms, and $R^7$ and $R^8$ are individually hydrogen or substituted or unsubstituted alkyl, preferably having 1 to 30 carbon atoms.

Preferred substituents of the groups $R^1$–$R^8$ include alkyl, phenyl, alkoxy, aryloxy, halogen, acyl, acyloxy, alkoxycarbonyl, acylamino, carbamoyl, sulfonamido, sulfamoyl, sulfonyl and/or sulfoxyl groups. It is preferred that the compounds I and IV contain at least twelve carbon atoms so as to minimize water solubility and volatility.

The protic imidazoles and pyridines used in the instant invention can be unballasted or ballasted. The ballast group renders the protic imidazole or pyridine substantially immobile. In other words, the ballasted protic imidazole or pyridine includes a group of such molecular size and configuration as to render the compound nondiffusible as described, for example, in U.S. Pat. Nos. 4,420,556 and 4,923,789. Advantageous ballast groups include alkyl and aryl groups having from about 8 to 32 carbon atoms.

The following are examples of preferred protic imidazoles and pyridines useful for the practice of the instant invention:

1)

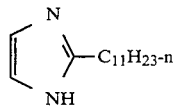

2)

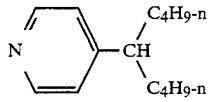

3)

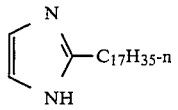

4)

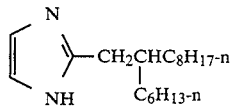

5)

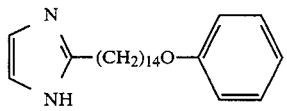

6)

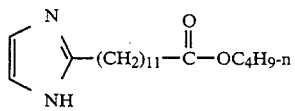

7)

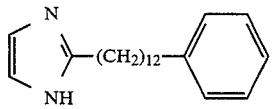

8)

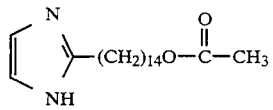

9)

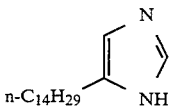

10)

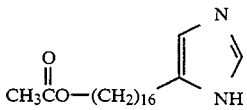

11)

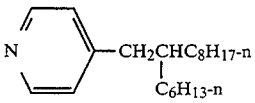

12)

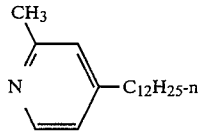

-continued

13)

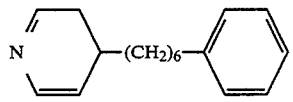

14)

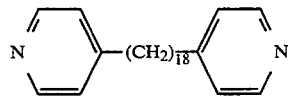

15)

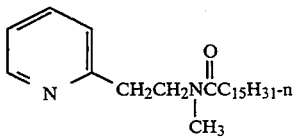

16)

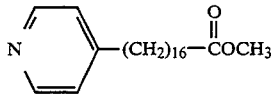

17)

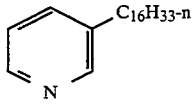

Particularly useful are compounds 1, 2, 3, and 15. The two-equivalent pyrazolone magenta couplers which are preferably used in the compositions according to the instant invention are represented by formula VI

VI

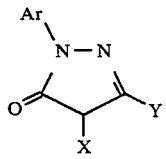

in which

Ar is an aryl group having one or more substituents selected from the group consisting of halogen, cyano, alkylsulfonyl, arylsulfonyl, sulfamoyl, sulfonamido, carbamoyl, carbonamido, alkoxycarbonyl, aryloxycarbonyl, acyloxy, alkoxy, aryloxy, ureido, nitro, alkyl or trifluoromethyl, or is a substituted pyridyl group, X is a coupling-off group selected from the group consisting of an arylthio group, an alkylthio group, an aryloxy group, an alkoxy group, an acyloxy group, a nitrogen-containing heterocyclic group, an imido group, a sulfonamido group, a carbonamido group, a sulfonyloxy group and an arylazo group, each of which can be unsubstituted or substituted, or halogen, and Y is substituted or unsubstituted anilino, substituted or unsubstituted acylamino or substituted or unsubstituted ureido, any of which may contain 6 to 30 carbons.

Preferred Ar groups are represented by formula VII

VII

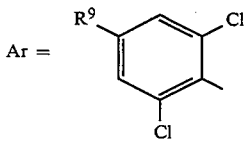

in which $R^9$ is halogen, cyano, alkylsulfonyl, arylsulfonyl, sulfamoyl, sulfonamido, carbamoyl, carbonamido, ureido, alkoxycarbonyl, aryloxycarbonyl, acyloxy, alkoxy, aryloxy, nitro or trifluoromethyl.

Exemplary coupling-off groups X include pyrazolyl, imidazolyl, succinimido and hydantoinyl. Especially preferred coupling-off groups are arylthio coupling-off groups represented by the formula VIII

VIII

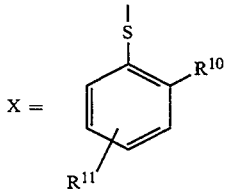

in which $R^{11}$ is in the para or either meta position relative to the sulfur atom and $R^{10}$ and $R^{11}$ are individually alkyl, alkoxy, aryloxy, carbonamido, ureido, carbamate, sulfonamido, carbamoyl, sulfamoyl, acyloxy, alkoxycarbonyl, amino or carboxyl, each of which can be substituted or unsubstituted, hydrogen, or halogen.

Especially preferred coupling-off groups are those in which $R^{10}$ has at least one carbon atom and in which the total number of carbon atoms in $R^{10}$ and $R^{11}$ together is between 5 and 25 inclusive.

Preferred substituents for Y include halogen, alkyl, aryl, alkoxy, aryloxy, carbonamido, carbamoyl, sulfonamido, sulfamoyl, alkylsulfoxyl, arylsulfoxyl, alkylsulfonyl, arylsulfonyl, alkoxycarbonyl, aryloxycarbonyl, acyl, acyloxy, ureido, imido, carbamate, heterocyclic, cyano, trifluoromethyl, alkylthio, nitro, carboxyl and hydroxyl groups, as well as groups which serve as linkers to or are part of a polymeric chain, forming polymeric couplers. Such polymeric couplers are disclosed, for example, in U.S. Pat. Nos. 4,367,282 and 4,388,404, which are incorporated by reference.

A particularly preferred Y is an anilino group represented by formula IX

IX

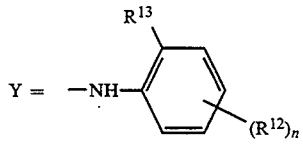

in which $R^{12}$ is hydrogen an alkyl, alkoxy, aryloxy, carbonamido, carbamoyl, sulfonamido, sulfamoyl, alkylsulfonyl, arylsulfoxyl, alkylsulfonyl, alkoxycarbonyl, aryloxycarbonyl, acyloxy, ureido, imido, carbamate, heterocyclic, cyano, nitro, acyl, trifluoromethyl, alkylthio or carboxyl group, or halogen, $R^{13}$ is hydrogen, halogen, or an alkyl, alkoxy, aryloxy, alkylthio, carbonamido, carbamoyl, sulfonamido, sulfamoyl, alkylsulfonyl, arylsulfonyl, alkoxycarbonyl, acyloxy, acyl, cyano, nitro or trifluoromethyl group, and n is 1 or 2, wherein if $R^{12}$ is other than hydrogen, then it may be in the para or either meta position relative to the NH group.

Preferably $R^{13}$ is a chloro or alkoxy group. Examples of two-equivalent pyrazolone magenta couplers useful for the practice of the instant invention are given below:

M1)

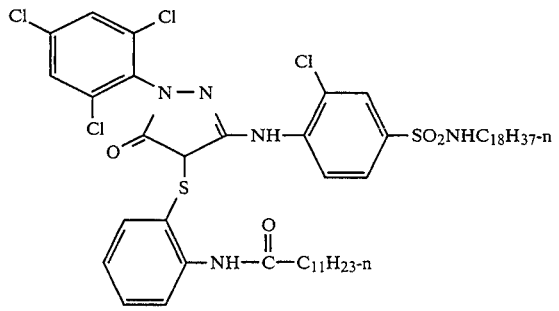

M2)

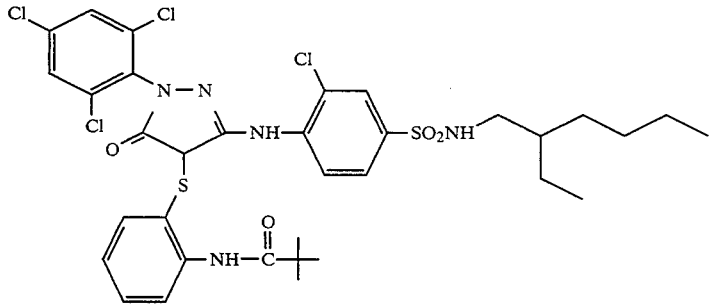

M3)

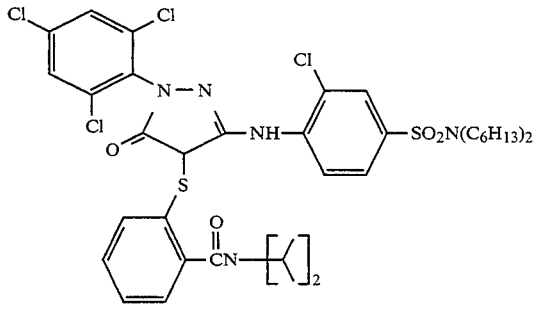

M4)

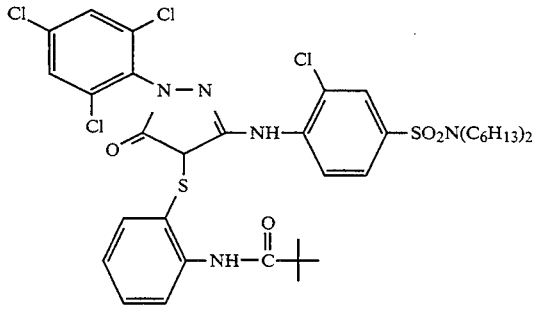

-continued
M5)
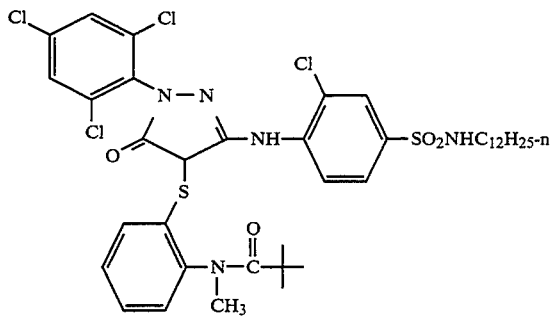
M6)
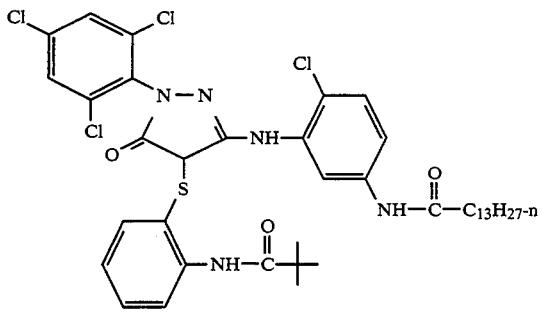
M7)
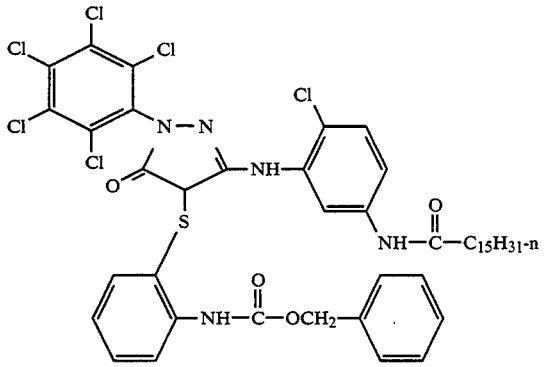
M8)
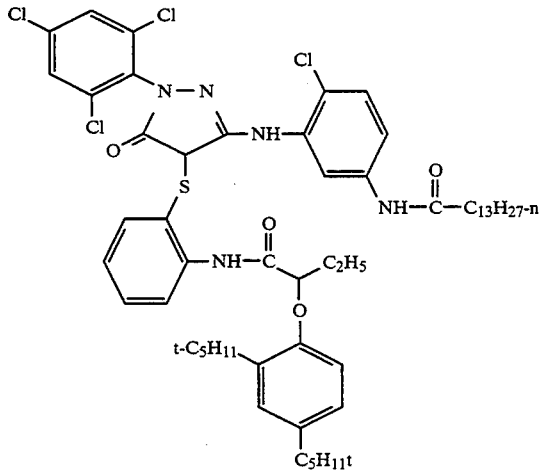

-continued
M9)
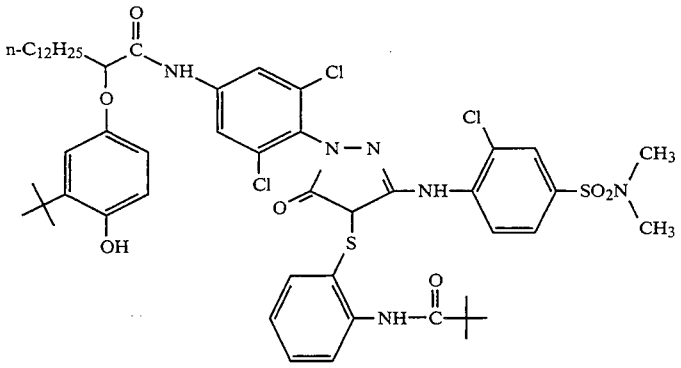
M10)
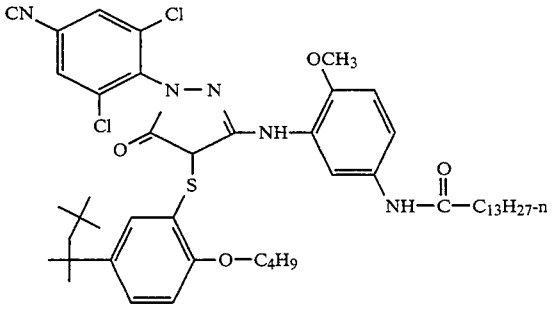
M11)
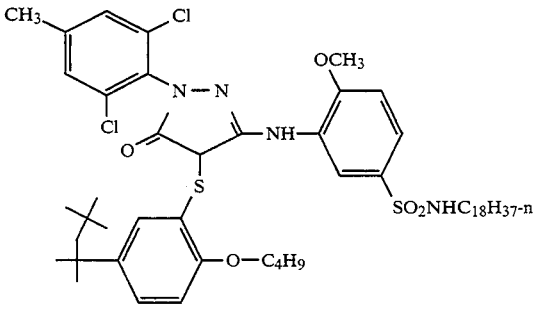
M12)
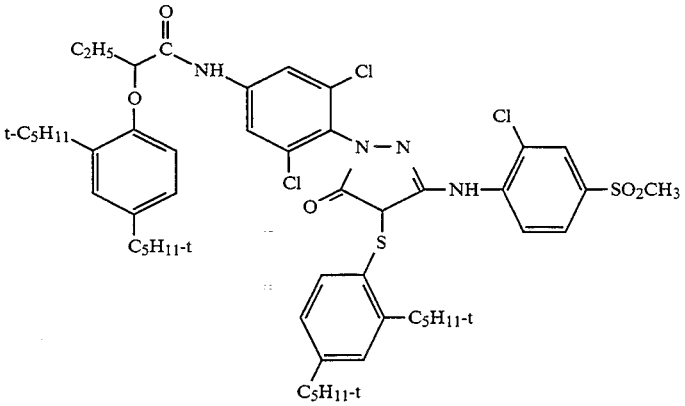

-continued
M13)
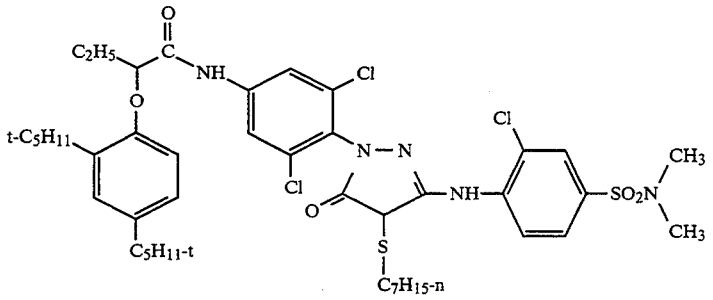
M14)
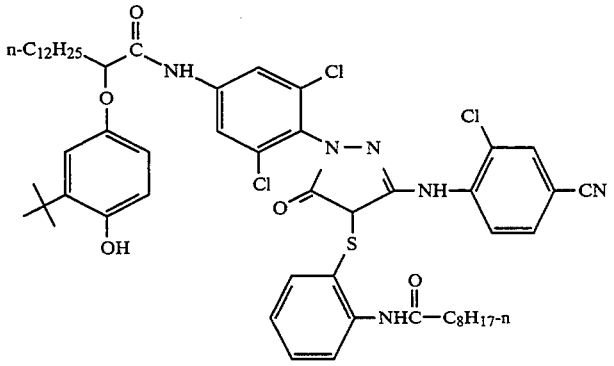
M15)
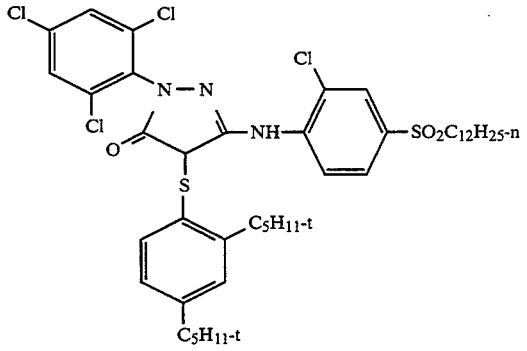
M16)
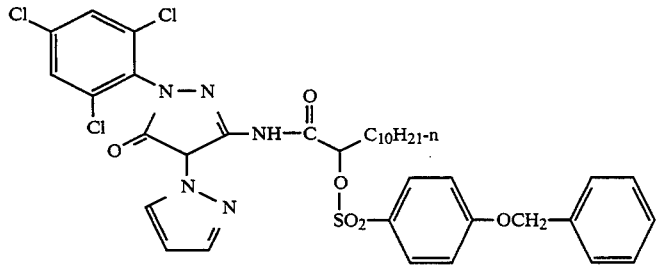
M17)
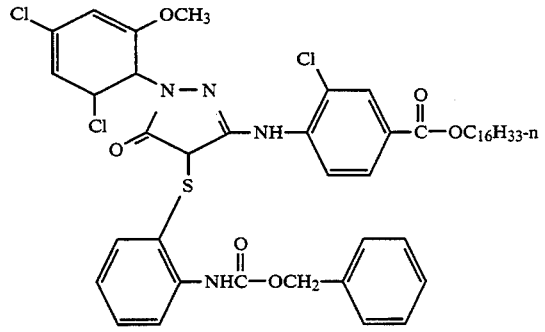

-continued

M18)

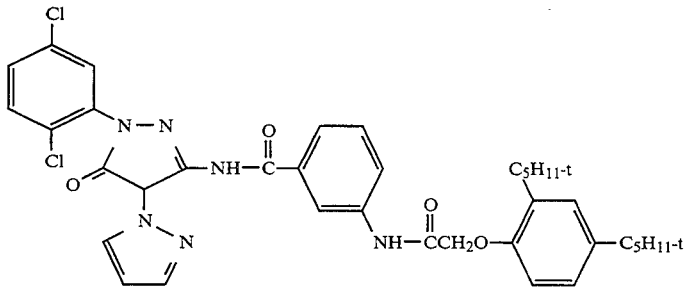

M19)

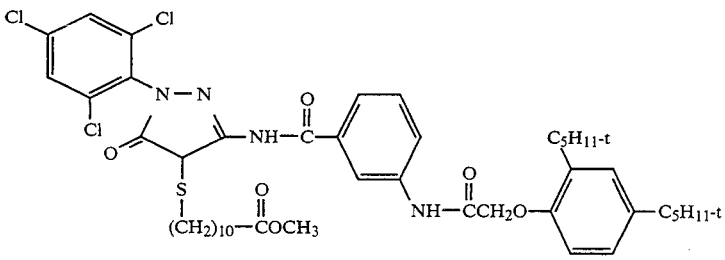

M20)

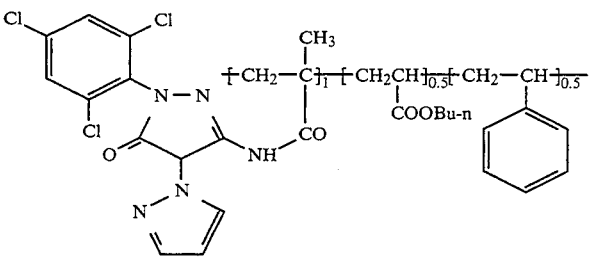

The couplers and addenda discussed above can be incorporated into a photographic element according to the methods described in Research Disclosure, December 1989, Item 308119. Couplers and other addenda can be dispersed in a photographic emulsion as oil-in-water dispersions with the aid of a high-boiling organic solvent commonly known in the photographic art as a coupler solvent. Such coupler solvents include, for example, di-n-butyl phthalate, di-t-butyl phthalate, diisopropyl phthalate, di-t-octyl phthalate, dicyclohexyl phthalate, bis(2-ethylhexyl) phthalate, didodecyl phthalate, triphenyl phosphate, tricresyl phosphate, 2-ethylhexyl diphenyl phosphate, tricyclohexyl phosphate, tris(2-ethylhexyl)phosphate, tridodecyl phosphate, tributoxyethyl phosphate, trichloropropyl phosphate, bis(2-ethylhexyl) phosphonate, 2-ethylhexyl benzoate, dodecyl benzoate, 2-ethylhexyl p-hydroxybenzoate, 1,4-cyclohexylene dimethylene bis(2-ethylhexanoate), dioctyl azelate, glycerol tributyrate, isostearyl lactate, trioctyl citrate, isostearyl alcohol, 2,4-di-t-amylphenol, 2,4-di-n-pentylphenol, N,N-diethyl dodecanamide, N-tetradecyl pyrrolidone, N-n-butyl acetanilide, N,N-dibutyl-2-butoxy-5-t-octylaniline, paraffin, dodecyl benzene and diisopropylnaphthalene.

In preparing the solutions of couplers, etc., auxiliary solvents can be employed, which can later be removed by evaporation, noodle-washing or ultrafiltration. Examples of auxiliary solvents are ethyl acetate, butyl acetate, ethyl propionate, methyl ethyl ketone, cyclohexanone, 2-ethoxyethyl acetate, 2-(2-butoxyethoxy)ethyl acetate and dimethylformamide. Examples of useful coupler solvents are described, for example, in Jelley et al., U.S. Pat. Nos. 2,322,027: Sawdey et al., 2,533,514; Fierke et al., 2,801,171; Smith, 3,748,141; and Krishnamurthy, 4,540,657 and 4,684,606.

In the following discussion of suitable materials for use in the emulsions and elements according to the invention, reference will be made to Research Disclosure, December 1989, Item 308119, published by Kenneth Mason Publications Ltd., Emsworth, Hampshire PO10 7DQ, U.K., the disclosures of which are incorporated in their entireties herein by reference. This publication will be identified hereafter as "Research Disclosure". The elements of the invention can comprise emulsions and addenda described in these publications and publications referenced therein.

The silver halide emulsions employed in the elements according to the invention can comprise silver bromide, silver chloride, silver iodide, silver chlorobromide, silver chloroiodide, silver bromoiodide, silver chlorobromoiodide or mixtures thereof. The emulsions can include silver halide grains of any conventional shape or size. Specifically, the emulsions can include coarse, medium, or fine silver halide grains. High aspect ratio tabular grain emulsions are specifically contemplated, such as those disclosed by Mignot, U.S. Pat. Nos. 4,386,156; Wey, 4,399,215; Maskasky, 4,400,463; Wey et al., 4,414,306; Maskasky, 4,414,966; Daubendiek et al., 4,424,310; Solberg et al., 4,433,048; Wilgus et al., 4,434,226; Maskasky, 4,435,501; Evans et al., 4,504,570; and Daubendiek et al., 4,672,027 and 4,693,964. Also specifically contemplated are those silver bromoiodide grains with a higher molar proportion of iodide in the core of the grain than in the periphery of the grain, such as those described in U.K. Patent No. 1,027,146; Japanese Patent 544/48521; U.S. Pat. Nos. 4,379,837;

4,444,877; 4,565,778; 4,636,461; 4,665,012; 4,668,614; 4,686,178; and 4,728,602; and in European Patent 264,954. The silver halide emulsions can be either monodisperse or polydisperse as precipitated. The grain size distribution of the emulsions can be controlled by silver halide grain separation techniques or by blending silver halide emulsions of differing grain sizes.

Sensitizing compounds, such as compounds of copper, thallium, lead, bismuth, cadmium and Group VIII noble metals, can be present during precipitation of the silver halide emulsion.

The emulsions can be surface-sensitive emulsions, that is, emulsions that form latent images primarily on the surfaces of the silver halide grains, or internal latent image-forming emulsions, that is, emulsions that form latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

The silver halide emulsions can be surface sensitized. Noble metal (for example, gold), middle chalcogen (such as sulfur, selenium or tellurium), and reduction sensitizers, employed individually or in combination, are specifically contemplated. Typical chemical sensitizers are listed in Research Disclosure, Section III.

The silver halide emulsions can be spectrally sensitized with dyes from a variety of classes, including the polymethine dye class, which includes the cyanines, merocyanines, complex cyanines and merocyanines (such as tri-, tetra- and polynuclear cyanines and merocyanines), oxonols, hemioxonols, styryls, merostyryls and streptocyanines. Illustrative spectral sensitizing dyes are described in Research Disclosure, Section IV and the publications cited therein.

Suitable vehicles for the emulsion layers and other layers of elements according to the invention are described in Research Disclosure, Item 308119, Section IX and the publications cited therein.

In addition to the magenta couplers described herein, the photographic elements according to the invention can include additional couplers such as those described in Research Disclosure Section VII, paragraphs D-G and the publications cited therein. These additional couplers can be incorporated as described in Research Disclosure Section VII, paragraph C and the publications cited therein. The coupler combinations according to the invention can be used with colored masking couplers such as described in U.S. Pat. No. 4,883,746, with image modifying couplers such as described in U.S. Pat. Nos. 3,148,062; 3,227,554; 3,733,201; 4,409,323; and 4,248,962 and with couplers that release bleach accelerators such as described in European Patent Application 193,389.

A photographic element according to the invention, or individual layers thereof, can also include any of a number of other well-known additives and layers. These include, for example, optical brighteners (see Research Disclosure Section V), antifoggants and image stabilizers (see Research Disclosure Section VI), light-absorbing materials such as filter layers of intergrain absorbers, and light-scattering materials (see Research Disclosure Section VIII), gelatin hardeners (see Research Disclosure Section X), oxidized developer scavengers, coating aids and various surfactants, overcoat layers, interlayers, barrier layers and antihalation layers (see Research Disclosure Section VII, paragraph K), antistatic agents (see Research Disclosure Section XIII), plasticizers and lubricants (see Research Disclosure Section XII), matting agents (see Research Disclosure Section XVI), antistain agents and image dye stabilizers (see Research Disclosure Section VII, paragraphs I and J), development-inhibitor releasing couplers and bleach accelerator-releasing couplers (see Research Disclosure Section VII, paragraph F), development modifiers (see Research Disclosure Section XXI), and other additives and layers known in the art.

The photographic elements according to the invention can be coated on a variety of supports as described in Research Disclosure Section XVII and the references cited therein. These supports include polymeric films, such as cellulose esters (for example, cellulose triacetate and diacetate) and polyesters of dibasic aromatic carboxylic acids with divalent alcohols (such as polyethylene terephthalate), paper, and polymer-coated paper.

Photographic elements according to the invention can be exposed to actinic radiation, typically in the visible region of the spectrum, to form a latent image as described in Research Disclosure Section XVIII, and then processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylene diamines. Especially preferred are 4-amino-3-methyl-N,N-diethylaniline hydrochloride, 4-amino-3-methyl-N-ethyl-N-$\beta$-(methanesulfonamido)ethylaniline sulfate hydrate, 4-amino-3-methyl-N-ethyl-N-$\beta$-hydroxyethylaniline sulfate, 4-amino-3-$\beta$-(methanesulfonamido)ethyl-N,N-diethylaniline hydrochloride and 4-amino-N-ethyl-N-(2-methoxyethyl)-m-toluidine di-p-toluenesulfonic acid.

With negative-working silver halide, the process step described above leads to a negative image. The described elements are preferably processed in the known C-41 color process as described in, for example, the British Journal of Photography Annual of 1988, pages 196–198. The heterocyclic nitrogen addenda allow use of the existing process without addition of a stop bath. This is because the stop bath is used to control continued coupling, and the addenda perform this function. To obtain a positive (or reversal) image, the color development step can be preceded by development with a non-chromogenic developing agent to develop exposed silver halide, but not form dye, and then uniformly fogging the element to render unexposed silver halide developable, followed by development with a chromogenic developer. Alternatively, a direct-positive emulsion can be employed to obtain a positive image.

Development is followed by the conventional steps of bleaching, fixing, or bleach-fixing, to remove silver and silver halide, washing and drying. Bleaching and fixing can be performed with any of the materials known to be used for that purpose. Bleach baths generally comprise an aqueous solution of an oxidizing agent such as water soluble salts and complexes of iron (III) (such as potassium ferricyanide, ferric chloride, ammonium or potassium salts of ferric ethylenediaminetetraacetic acid), water-soluble dichromates (such as potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thioureas, and the like.

The invention is further illustrated by the following examples, without being limited thereby.

Addenda 1 and 2 were used in the examples. The following amine or aniline addenda served as comparative examples:

A)

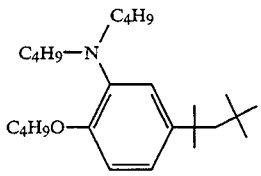

B) $N-(C_8H_{17}\text{-}n)_3$

C)

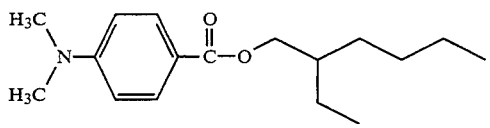

D)

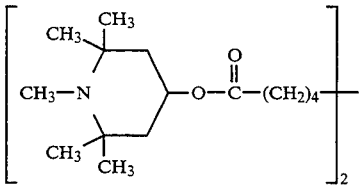

EXAMPLE 1

Dispersions of coupler M1 dissolved in tritolyl phosphate were prepared, containing various amine addenda. The weight ratio of coupler to solvent plus amine was fixed at 1:1, but the ratio of coupler solvent to amine was varied to some extent in order to maintain coupler activity (gamma). Addenda which were found to yield greater reductions in activity in preliminary studies with hand coatings were used at lower levels. The dispersions were coated at 0.05 mmol/ft$^2$ in the format shown below. The C-41 bleach pH was adjusted to 6.00 to simulate the pH of a seasoned bleach solution. The increase in Dmin values obtained without a stop bath, referred to as delta Dmin, is a measure of continued coupling. Photographic gamma values, which serve as a measure of activity, were obtained from plots of status M green density vs exposure.

| Coating format |
|---|
| 250 mg/sq ft Gelatin + 1.75% BVSME* (Hardener) |
| 0.05 mmoles/sq ft Coupler (51 mg/sq ft of M1) |
| Coupler Solvent + Amine @ equal weight to Coupler |
| 350 mg/sq ft Gelatin |
| 100 mg/sq ft Silver as a silver halide emulsion |
| Cellulose Acetate Butyrate Support |

*BVSME = $(CH_2{=}CHSO_2CH_2)_2O$

| Processing conditions | |
|---|---|
| Solution (all at 100 F.) | Time |
| KF12 Developer | 3'5" |
| A) Stop Bath | 1' |
| B) No Stop Bath | — |
| Flexicolor Bleach (Adjusted to Ph −6.0) | 4' |
| Wash | 3' |
| KF12 Fix | 4' |
| Wash | 4' |

Amine addenda and levels, delta Dmin values and gamma values for the processed coatings are listed in Table I. Values for the ratio of gamma to delta Dmin are also listed in Table I. This ratio serves as an indication of the overall effectiveness of an addendum in maintaining coupler activity while reducing continued coupling. The larger the ratio, the more effective the addendum.

TABLE I

| Addendum | Ratio of S1 to Addendum | Delta Dmin | Gamma | Gamma/ Delta Dmin |
|---|---|---|---|---|
| None (control) | 1.00:0.00 | 0.25 | 3.84 | 15.4 |
| 1 | 0.85:0.15 | 0.06 | 2.72 | 45.3 |
| 2 | 0.80:0.20 | 0.14 | 3.77 | 26.9 |
| A | 0.80:0.20 | 0.15 | 3.44 | 22.9 |
| B | 0.75:0.25 | 0.23 | 3.56 | 15.5 |
| C | .90:0.10 | 0.18 | 2.86 | 15.9 |
| D | 0.90:0.10 | 0.12 | 3.25 | 27.1 |

As is evident, compounds 1 and 2 are highly effective addenda. The stability of compound 2 toward oxidation, associated with its high oxidation potential, is an added advantage of this compound, as noted above.

EXAMPLE 2

Dispersions of coupler M2 were prepared and coated with silver halide emulsion in the same manner as in Example 1. Coatings were prepared with addenda 1 and A, and with no amine addendum. The coatings were exposed, processed and analyzed as in Example 1. Results are summarized in Table II.

TABLE II

| Addendum | Ratio of S1 to Addendum | Delta Dmin | Gamma | Gamma/ Delta Dmin |
|---|---|---|---|---|
| None (control) | 1.00:0.00 | 0.16 | 1.84 | 11.5 |
| 1 | 0.85:0.15 | 0.09 | 1.64 | 18.2 |
| A | 0.80.0.20 | 0.11 | 1.77 | 16.1 |

EXAMPLE 3

Dispersions of couplers M6 or M8 were prepared and coated at 0.05 mmol/ft$^2$ with the silver halide emulsion (at 100 mg Ag/ft$^2$) as in Example 1. Coatings were prepared with solvent as in Example 1 and no amine addendum, and with the solvent plus either compound 1 or A at 10% by weight. Films were exposed, processed and analyzed as in Example 1. Results are summarized in

TABLE III

| Addendum | Ratio of S1 to Addendum | Delta Dmin | Gamma | Gamma/ Delta Dmin |
|---|---|---|---|---|
| None (control) | 1.00:0.00 | 0.22 | 1.81 | 8.2 |

TABLE III-continued

| Addendum | Ratio of S1 to Addendum | Delta Dmin | Gamma | Gamma/ Delta Dmin |
|---|---|---|---|---|
| 1 | 0.90:0.10 | 0.15 | 1.74 | 11.6 |
| A | 0.90:0.10 | 0.19 | 1.78 | 9.4 |
| | Using Coupler M6 | | | |

TABLE IV

| Addendum | Ratio of S1 to Addendum | Delta Dmin | Gamma | Gamma/ Delta Dmin |
|---|---|---|---|---|
| None (control) | 1.00:0.00 | 0.26 | 2.62 | 10.1 |
| 1 | 0.90:0.10 | 0.12 | 2.07 | 17.1 |
| A | 0.90:0.10 | 0.19 | 2.49 | 13.1 |
| | Using Coupler M8 | | | |

From the gamma/delta Dmin ratios shown in Tables III and IV, it is evident that addendum 1 according to the invention is superior to comparative addendum A in reducing continued coupling while maintaining coupler activity (gamma).

It is to be understood that the foregoing detailed description and specific examples, while indicating preferred embodiments of the present invention, are given by way of illustration and not limitation. Many changes and modifications within the scope of the present invention may be made without departing from the spirit thereof, and the invention includes all such modifications.

What is claimed is:

1. A photographic element comprising a support and a silver halide emulsion layer having associated therewith a two-equivalent pyrazolone magenta dye-forming coupler, wherein said element further comprises a heterocyclic nitrogen compound selected from the group consisting of protic imidazoles represented by general formula I, and pyridines represented b general formula IV:

I

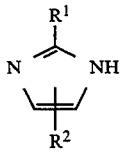

in which $R^1$ or $R^2$ is hydrogen and the other one is unsubstituted or substituted straight-chain or branched alkyl, unsubstituted or substituted alkenyl, unsubstituted or substituted alkoxy groups, unsubstituted or substituted aryl groups, or groups of the formulae II

II

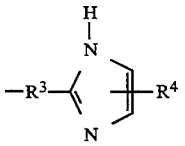

or III

-continued

III

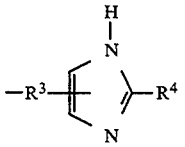

wherein $R^3$ is unsubstituted or substituted alkylene and $R^4$ is hydrogen, unsubstituted or substituted straight-chain or branched alkyl, or unsubstituted or substituted alkenyl, with the proviso that no more than one or $R^1$ and $R^2$ is a group of the formulae II or III;

IV

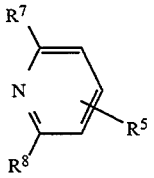

in which $R^5$ is hydrogen, unsubstituted or substituted straight-chain or branched alkyl, unsubstituted or substituted alkenyl, or a group of the formula V

V

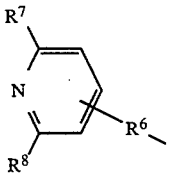

wherein $R^6$ is unsubstituted or substituted alkylene and $R^7$ and $R^8$ are individually hydrogen or substituted or unsubstituted alkyl;

and wherein when said groups $R^1$–$R^4$ are substituted groups as defined, they are individually substituted with one or more alkyl, phenyl, alkoxy, aryloxy, halogen, acyl, acyloxy, alkoxycarbonyl, acylamino, carbamoyl, sulfonamido,sulfamoyl, sulfonyl or sulfoxy group.

2. A photographic element as claimed in claim 1, wherein said heterocyclic nitrogen compound is a protic imidazole of formula I.

3. A photographic element as claimed in claim 2, wherein said protic imidazole is

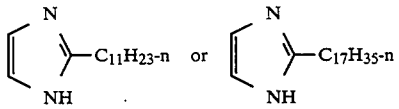

4. A photographic element as claimed in claim 1, wherein said heterocyclic nitrogen compound is a pyridine of formula IV.

5. A photographic element as claimed in claim 4, wherein each of $R^5$–$R^8$ are unsubstituted or substituted with one or more phenyl, alkoxy, aryloxy, halogen, acyl, acyloxy, alkoxycarbonyl, acylamino, carbamoyl, sulfonamido, sulfamoyl, sulfonyl or sulfoxyl group.

6. A photographic element as claimed in claim 4, wherein said pyridine is

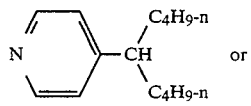

or

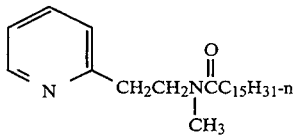

7. A photographic element as claimed in claim 1, wherein said heterocyclic nitrogen compound contains at least twelve carbon atoms.

8. A photographic element as claimed in claim 1, wherein said magenta dye-forming coupler is represented by formula VI

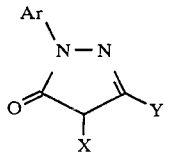

VI in which

Ar is an aryl group having at least one substituent selected from the group consisting of halogen, cyano, alkylsulfonyl, arylsulfonyl, sulfamoyl, sulfonamido, carbamoyl, carbonamido, alkoxycarbonyl, aryloxycarbonyl, acyloxy, alkoxy, aryloxy, ureido, nitro, alkyl or trifluoromethyl, or is a substituted pyridyl group, X is a coupling-off group selected from the group consisting of an arylthio group, an alkylthio group, an aryloxy group, an alkoxy group, an acyloxy group, a nitrogen-containing heterocyclic group, an imido group, a sulfonamido group, a carbonamido group, a sulfonyloxy group, and an arylazo group, each of which can be unsubstituted or substituted, or halogen, and Y is substituted or unsubstituted anilino, substituted or unsubstituted acylamino or substituted or unsubstituted ureido, any of which contain 6 to 30 carbons.

9. A photographic element as claimed in claim 8, wherein said aryl group Ar is represented by formula VII

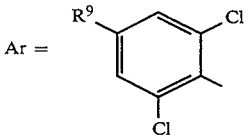

VII in which $R^9$ is halogen, cyano, alkylsulfonyl, arylsulfonyl, sulfamoyl, sulfonamido, carbamoyl, carbonamido, ureido, alkoxycarbonyl, aryloxycarbonyl, acyloxy, alkoxy, aryloxy, nitro or trifluoromethyl.

10. A photographic element as claimed in claim 8, wherein said coupling-off group X is a pyrazolyl, imidazolyl, succinimido, or hydantoinyl group.

11. A photographic element as claimed in claim 8, wherein said coupling-off group X is an arylthio coupling-off group represented by the formula VIII

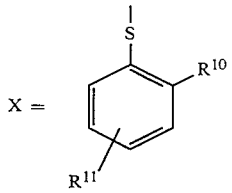

VIII in which $R^{11}$ is in the para or either meta position relative to the sulfur atom, and $R^{10}$ and $R^{11}$ are individually alkyl, alkoxy, aryloxy, carbonamido, ureido, carbamate, sulfonamido, carbamoyl, sulfamoyl, acyloxy, alkoxycarbonyl, amino, or carboxyl, each of which can be substituted or unsubstituted, hydrogen, or halogen.

12. A photographic element as claimed in claim 11, wherein $R^{10}$ has at least one carbon atom and wherein the total number of carbon atoms in $R^{10}$ and $R^{11}$ together is between 5 and 25 inclusive.

13. A photographic element as claimed in claim 8, wherein Y is substituted with halogen or an alkyl, aryl, alkoxy, aryloxy, carbonamido, carbamoyl, sulfonamido, sulfamoyl, alkylsulfoxyl, arylsulfoxyl, alkylsulfonyl, arylsulfonyl, alkoxycarbonyl, aryloxycarbonyl, acyl, acyloxy, ureido, imido, carbamate, heterocyclic, cyano, trifluoromethyl, alkylthio, nitro, carboxyl, or hydroxyl group, or with a group which serves as linker to or is part of a polymeric chain.

14. A photographic element as claimed in claim 8, wherein Y is an anilino group represented by formula IX

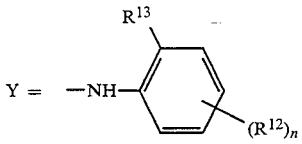

IX in which $R^{12}$ is hydrogen an alkyl, alkoxy, aryloxy, carbonamido, carbamoyl, sulfonamido, sulfamoyl, arylsulfoxyl, alkylsulfonyl, alkoxycarbonyl, aryloxycarbonyl, acyloxy, ureido, imido, carbamate, heterocyclic, cyano, nitro, acyl, trifluoromethyl, alkylthio or carboxyl group, or halogen, $R^{13}$ is hydrogen, halogen, or an alkyl, alkoxy, aryloxy, alkylthio, carbonamido, carbamoyl, sulfonamido, sulfamoyl, alkylsulfonyl, arylsulfonyl, alkoxycarbonyl, acyloxy, acyl, cyano, nitro or trifluoromethyl group, and n is 1 or 2, wherein if $R^{12}$ is other than hydrogen, then it may be in the para or either meta position relative to the NH group.

15. A photographic element as claimed in claim 14, wherein $R^{13}$ is a chlorine atom or an alkoxy group.

16. A photographic element as claimed in claim 1, comprising a weight ratio of said nitrogen compound to said coupler of about 0.02 to about 2.0.

17. A composition comprising a two-equivalent pyrazolone magenta dye-forming coupler and a heterocyclic nitrogen addendum selected from the group consisting of protic imidazoles represented by general formula I, and pyridines represented by general formula IV:

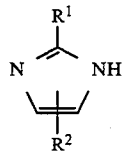

I in which $R^1$ or $R^2$ is hydrogen and the other one is unsubstituted or substituted straight-chain or branched alkyl, unsubstituted or substituted alkenyl, unsubstituted or substituted alkoxy groups, unsubstituted or substituted aryl groups, or groups of the formulae II

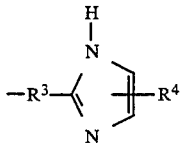

II or III

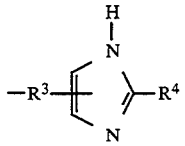

III wherein $R^3$ is unsubstituted or substituted alkylene and $R^4$is hydrogen, unsubstituted or substituted straight-chain or branched alkyl, or unsubstituted or substituted alkenyl, with the proviso that no more than one of $R^1$ and $R^2$ is a group of the formulae II or III;

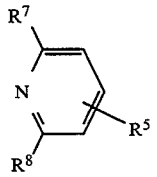

IV in which $R^5$ is hydrogen, unsubstituted or substituted straight-chain or branched alkyl, unsubstituted or substituted alkenyl, or a group of the formula V

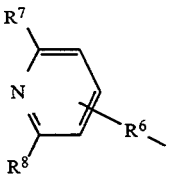

V wherein $R^6$ is unsubstituted or substituted alkylene and $R^7$ and $R^8$are individually hydrogen or substituted or unsubstituted alkyl;

and wherein when said groups $R^1$–$R^4$ are substituted groups as defined, they are individually substituted with one or more alkyl, phenyl, alkoxy, aryloxy, halogen, acyl, acyloxy, alkoxycarbonyl, acylamino, carbamoyl, sulfonamido, sulfamoyl, sulfonyl or sulfoxyl group.

18. A composition as claimed in claim 17, wherein said addendum is a protic imidazole of formula I.

19. A composition as claimed in claim 17, wherein said addendum is a pyridine of formula IV.

20. A composition as claimed in claim 17 in the form of a dispersion.

21. A composition as claimed in claim 17 wherein the two-equivalent pyrazolone magenta dye-forming coupler is represented by formula VI

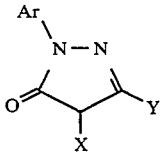

VI in which

Ar is an aryl group having at least one substituent selected from the group consisting of halogen, cyano, alkylsulfonyl, arylsulfonyl, sulfamoyl, sulfonamido, carbamoyl, carbonamido, alkoxycarbonyl, aryloxycarbonyl, acyloxy, alkoxy, aryloxy, ureido, nitro, alkyl, or trifluoromethyl, or is a substituted pyridyl group, X is a coupling-off group selected from the group consisting of an arylthio group, an alkylthio group, an aryloxy group, an alkoxy group, an acyloxy group, a nitrogen-containing heterocyclic group, an imido group, a sulfonamido group, a carbonamido group, a sulfonyloxy group, and an arylazo group, each of which can be unsubstituted or substituted, or halogen, and Y is substituted or unsubstituted anilino, substituted or unsubstituted acylamino or substituted or unsubstituted ureido, any of which may contain 6 to 30 carbons.

22. A composition as claimed in claim 17, wherein the weight ratio of said heterocyclic nitrogen addendum to said coupler is about 0.02 to about 2.0.

23. A multicolor photographic element comprising a support bearing a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler and a yellow dye image-forming unit comprising at least one blue-sensitive silver halide emulsion layer having associated therewith at least one yellow dye-forming coupler, wherein said magenta dye-forming coupler is a two-equivalent pyrazolone magenta coupler, and wherein said magenta dye-forming coupler is associated with a heterocyclic nitrogen addendum selected from the group consisting of protic imidazoles represented by general formula I, and pyridines represented by general formula IV:

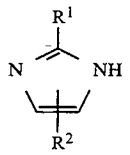

I in which $R^1$ or $R^2$ is hydrogen and the other one is unsubstituted or substituted straight-chain or branched alkyl, unsubstituted or substituted alkenyl, unsubstituted or substituted alkoxy groups, unsubstituted or substituted aryl groups, or groups of the formulae II

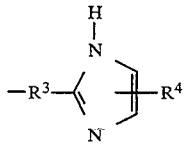

II or III

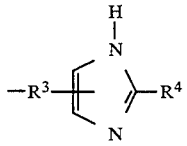

III wherein $R^3$ is unsubstituted or substituted alkylene and $R^4$ is hydrogen, unsubstituted or substituted straight-chain or branched alkyl, or unsubstituted or substituted alkenyl, with the proviso that no more than one of $R^1$ and $R^2$ is a group of the formulae II or III;

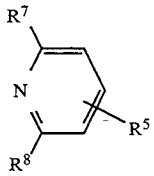

IV in which $R^5$ is hydrogen, unsubstituted or substituted straight-chain or branched alkyl, unsubstituted or substituted alkenyl, or a group of the formula V

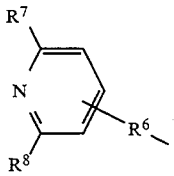

V wherein $R^6$ is unsubstituted or substituted alkylene and $R^7$ and $R^8$ are individually hydrogen or substituted or unsubstituted alkyl;

and wherein when said groups $R^1$–$R^4$ are substituted groups as defined, they are individually substituted with one or more alkyl, phenyl, alkoxy, aryloxy, halogen, acyl, acyloxy, alkoxycarbonyl, acylamino, carbamoyl, sulfonamido, sulfamoyl, sulfonyl or sulfoxyl group.

24. A process for developing an image in a photographic element comprising a support and a silver halide emulsion containing an imagewise distribution of developable silver halide grains, said process comprising the step of developing said element with a silver halide color developer in the presence of a two-equivalent dye-forming magenta coupler and a heterocyclic nitrogen compound selected from the group consisting of protic imidazoles represented by general formula I, and pyridines represented by general formula IV:

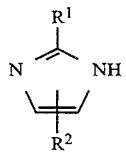

I in which $R^1$ or $R^2$ is hydrogen and the other one is unsubstituted or substituted straight-chain or branched alkyl, unsubstituted or substituted alkenyl, unsubstituted or substituted alkoxy groups, unsubstituted or substituted aryl groups, or groups of the formulae II

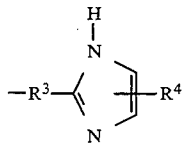

II or III

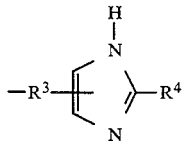

III wherein $R^3$ is unsubstituted or substituted alkylene and $R^4$ is hydrogen, unsubstituted or substituted straight-chain or branched alkyl, or unsubstituted or substituted alkenyl, with the proviso that no more than one of $R^1$ and $R^2$ is a group of the formulae II or III;

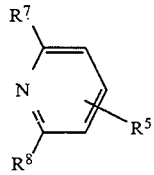

IV in which $R^5$ is hydrogen, unsubstituted or substituted straight-chain or branched alkyl, unsubstituted or substituted alkenyl, or a group of the formula V

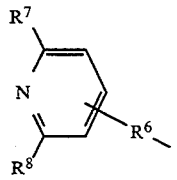

V wherein $R^6$ is unsubstituted or substituted alkylene and $R^7$ and $R^8$ are individually hydrogen or substituted or unsubstituted alkyl;

and wherein when said groups $R^1$–$R^4$ are substituted groups as defined, they are individually substituted with one or more alkyl, phenyl, alkoxy, aryloxy, halogen, acyl, acyloxy, alkoxycarbonyl, acylamino, carbamoyl, sulfonamido, sulfamoyl, sulfonyl or sulfoxyl group.

25. A process as claimed in claim 24, wherein no stop bath is employed after the development step.

26. A photographic silver halide emulsion comprising a two-equivalent pyrazolone magenta dye-forming coupler and a heterocyclic nitrogen addendum selected from the group consisting of protic imidazoles represented by general formula I, and pyridines represented by general formula IV:

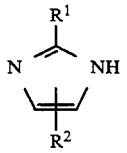

I in which $R^1$ or $R^2$ is hydrogen and the other one is unsubstituted or substituted straight-chain or branched alkyl, unsubstituted or substituted alkenyl, unsubstituted or substituted alkoxy groups, unsubstituted or substituted aryl groups, or groups of the formulae II

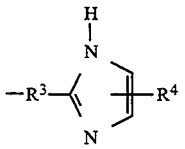

II or III

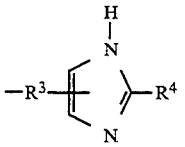

III wherein $R^3$ is unsubstituted or substituted alkylene and $R^4$ is hydrogen, unsubstituted or substituted straight-chain or branched alkyl, or unsubstituted or substituted alkenyl, with the proviso that no more than one of $R^1$ and $R^2$ is a group of the formulae II or III;

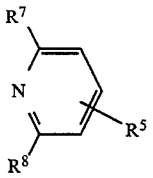

IV in which $R^5$ is hydrogen, unsubstituted or substituted straight-chain or branched alkyl, unsubstituted or substituted alkenyl, or a group of the formula V

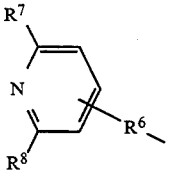

V wherein $R^6$ is unsubstituted or substituted alkylene and $R^7$ and $R^8$ are individually hydrogen or substituted or unsubstituted alkyl;

and wherein said groups $R^1$–$R^4$ are substituted groups as defined, they are individually substituted with one or more alkyl, phenyl, alkoxy, aryloxy, halogen, acyl, acyloxy, alkoxycarbonyl, acylamino, carbamoyl, sulfonamido, sulfamoyl, sulfonyl or sulfoxyl group.

* * * * *